US009834975B2

(12) United States Patent
Pignolet et al.

(10) Patent No.: US 9,834,975 B2
(45) Date of Patent: Dec. 5, 2017

(54) HAZARD ALERT DEVICE FOR ELEVATED BARRIER

(71) Applicant: Wildeck, Inc., Waukesha, WI (US)

(72) Inventors: Keith G. Pignolet, Wauwatosa, WI (US); Stephen M. Payne, Waukesha, WI (US)

(73) Assignee: Wildeck, Inc., Deerfield, IL (US)

( * ) Notice: Subject to any disclaimer, the term of this patent is extended or adjusted under 35 U.S.C. 154(b) by 0 days.

(21) Appl. No.: 15/056,044

(22) Filed: Feb. 29, 2016

(65) Prior Publication Data

US 2016/0253894 A1 Sep. 1, 2016

Related U.S. Application Data

(60) Provisional application No. 62/121,897, filed on Feb. 27, 2015.

(51) Int. Cl.

| | |
|---|---|
| ***E05F 15/40*** | (2015.01) |
| ***G08B 21/18*** | (2006.01) |
| ***E06B 11/02*** | (2006.01) |
| ***G08B 5/36*** | (2006.01) |

(52) U.S. Cl.

CPC ..... *E05F 15/40* (2015.01); *E06B 11/022* (2013.01); *G08B 5/36* (2013.01); *G08B 21/18* (2013.01)

(58) Field of Classification Search

USPC ..... 49/366, 367

See application file for complete search history.

(56) References Cited

U.S. PATENT DOCUMENTS 4,545,150 A * 10/1985 Williams ..... E05B 65/0007 292/148
6,634,139 B1 * 10/2003 Metz ..... B65G 69/2882 49/13
7,318,298 B2 * 1/2008 Marsden ..... E06B 9/04 362/152
7,334,624 B2 * 2/2008 Waldman ..... E05B 17/2053 160/144

(Continued)

OTHER PUBLICATIONS

Poolguard gate alarm manual web archive.pdf.*

(Continued)

*Primary Examiner* — Katherine Mitchell
*Assistant Examiner* — Marcus Menezes
(74) *Attorney, Agent, or Firm* — Wood Herron & Evans LLP

(57) ABSTRACT

A hazard alert device, which can be battery powered or hard wired, is configured to provide a hazard alert when a gate along an edge of an elevated surface is in the open position. Upon detecting the gate is in the open position, the device produces an audible and visual alert. When the gate, disposed within a portion of the barrier, is opened to allow the movement of people and/or materials to or from the elevated surface, the device includes a snooze mode enabling the audible alarm to be silenced for a period of time. If the gate is inadvertently left in the open position, the audible alert serves as a reminder to close the gate. This device may include first and second sensors with dual channels (output signals) and dual cross-checking processors that continually compare outputs from the sensor channels to identify any defect in the sensor or wiring.

13 Claims, 3 Drawing Sheets

(56) References Cited

U.S. PATENT DOCUMENTS

| | | | | |
|---|---|---|---|---|
| 7,380,375 | B2 * | 6/2008 | Maly | B65G 69/2882 340/524 |
| 9,284,135 | B2 * | 3/2016 | Sveum | B65G 69/2811 |
| 2013/0199094 | A1 * | 8/2013 | Lachance | G08B 13/08 49/13 |
| 2015/0097680 | A1 * | 4/2015 | Fadell | H04L 67/025 340/628 |
| 2016/0004581 | A1 * | 1/2016 | Linn | G06F 11/1658 714/37 |
| 2016/0040469 | A1 * | 2/2016 | Lietz | E05F 15/668 49/13 |

OTHER PUBLICATIONS

Poolguard gate alarm web archive.pdf.*

Ebay, http://www.ebay.co.uk/itm/321473546642?ssPageName=STRK:MESELX:IT&_trksid=p3984.m1555.I2649, Door Ajar Alarm/Open Reminder, Aug. 2014, Liverpool, Merseyside, United Kingdom, 2 pages.

STI-USA, http://www.sti-usa.com/product.asp?PartNo=STI-6400, Exit Stopper Multifunction Door Alarm STI-6400, 1 page.

Poolguard, http://www.poolguard.com/gate.asp, Gate Alarm—Model GAPT-2, 2 pages.

Australsurveillance, http://www.australsurveillance.com.au/dotl_frame.html, Door Open Too Long Alarm, 2 pages.

Gettrapped, http://www.gettrapped.com.au/index.php?route=product/product&product_id=60, Door Open Alarm System, 2 pages.

* cited by examiner

HAZARD ALERT DEVICE FOR ELEVATED BARRIER

CROSS-REFERENCE TO RELATED APPLICATIONS

This application claims priority to U.S. Provisional Patent Application Ser. No. 62/121,897, filed on Feb. 27, 1015, the entire disclosure of which is hereby incorporated by reference herein.

TECHNICAL FIELD

This disclosure generally pertains to improved workplace safety, and more particularly, to a hazard alert device that alerts an individual of a potential hazard when a gate of a barrier located at the perimeter of an elevated surface is open and/or unlocked.

BACKGROUND

Many industrial and commercial facilities have elevated floor surfaces with perimeter railings and operable gates which allow for the movement of supplies, equipment, and other materials on and off of the elevated floor. In some situations, the perimeter will have solid walls and gates. There are serious safety concerns whenever these gates need to be opened, with the gate never being opened longer than absolutely necessary. However, for convenience and other reasons, there may be incidences where the gate is left open for extended periods of time.

Conventional gates lack a method and system to alert people of hazards associated with an open floor edge. Further, such conventional gates lack a method of reminding people to promptly close gates of safety barriers.

SUMMARY

In an embodiment of the invention, a hazard alert device includes a barrier sensor and a signaling device including a delay mechanism. In an embodiment, an elevated surface has a barrier and a gate disposed along an edge of the elevated surface, with the gate being switchable between a closed position that obstructs the edge of the elevated surface and prevents movement of people and/or material, and an open position that allows for the movement of people and/or material. The barrier sensor is configured to sense whether the gate is in the closed position and to generate a closed signal in response thereto. The signaling device is in operative communication with the barrier sensor, and is configured to provide a visible alarm and/or an audible alarm when the barrier sensor has not generated the closed signal. The delay mechanism, once activated, is configured to silence the audible alarm for a predetermined period of time, to maintain the visible alarm throughout the period of time, and to reinitiate the audible alarm once the predetermined period of time has elapsed.

The hazard alert device utilizes a sensor, or multiple sensors, to detect when a fall-hazard exists. A fall-hazard may exist whenever the elevated movable barrier is not in the fully closed position. In some embodiments, the barrier sensor may be equipped with a coded magnet that signals that the gate is in the fully-closed position. In some embodiments, the barrier sensor detects that the gate is both in a fully-closed position and/or locked position.

In some embodiments, such as for use on a loading dock, the fall-hazard does not exist unless both the safety barrier is opened and a truck is not present; so the sensors may be arranged to detect both "no truck is present" and "the gate is not fully closed."

According to an embodiment, the hazard alert device may include both audible and visual signals that provide both a continuous alert as long as the elevated movable barrier is in the opened position. Upon detecting the fall-hazard, the device activates the visual and audible signals. In some embodiments, this alert may include flashing lights and a high-pitched pulsing horn. There may be multiple volume settings to ensure that the horn is loud enough to draw attention to the hazard situation.

When the gate of the barrier needs to be opened for the movement of material, or other items, the hazard alert device may provide a mechanism to silence the horn while the open gate is actively in use. According to various embodiments, the device may have a "snooze" button that, once pressed, silences the horn for an appropriate period of time. A flashing light, or other visual warning, may continue to signal the hazard condition during this time. In the event that the gate is left opened too long, and the "snooze period" had elapsed, the audible signal may resume.

In another embodiment, a method is provided for securing an elevated surface. According to an embodiment, an elevated surface may include a barrier along an edge of the elevated surface. The barrier may include an opening therethrough that is configured to allow the movement of people and/or materials with a gate residing within the opening, with the gate being movable between a closed position and an open position. The method includes sensing when the gate is in the open position, and in response to sensing the gate is in the open position, activating an audible alarm and a visible alarm, and enabling the audible alarm to be selectively deactivated for a period of time.

In a further embodiment, a method is provided for securing an elevated surface. According to an embodiment, the elevated surface may include a barrier along an edge of the elevated surface. The barrier may include an opening therethrough configured to allow the movement of people and/or materials with a gate residing within the opening. The method includes sensing when the gate is in the open position using a barrier sensor, sensing when a vehicle is not proximate the opening using a vehicle sensor, and in response to sensing the gate is in the open position and a vehicle is not proximate the opening, activating an alarm.

In another embodiment, a hazard alert system is provided for an elevated surface. The hazard alert system includes a barrier, a locking mechanism, and a hazard alert device. The barrier includes first and second swing gates pivoting about a pair of spaced vertical axes. The first and second swing gates are alignable along a plane. The locking mechanism locks the first and second swing gates in alignment along the plane such that the first and second swing gates are switchable between a locked position that locks the first and second swing gates together and prevents movement of people and/or material, and an unlocked position that allows for the movement of people and/or material. The hazard alert device includes a barrier sensor, a signaling device, and a controller located internal to the signaling device. The barrier sensor has a swing gate mounted portion and a locking mechanism mounted portion. The portions are in alignment when the first and second swing gates are aligned along the plane and when the locking mechanism is in locked position. The signaling device is mounted to the barrier located adjacent with and in alignment with one of the first and second swing gates. The controller is operatively connected to the swing gate mounted portion of the first sensor and also operatively connected to an audible alarm and a visible alarm. The controller is configured to silence the audible alarm for a predetermined period of time, maintain the visible alarm throughout the predetermined period of time, and reinitiate the audible alarm once the predetermined period of time has elapsed.

BRIEF DESCRIPTION OF THE DRAWINGS

The accompanying drawings, that are incorporated in and constitute a part of this specification, illustrate various embodiments of the invention and, together with the general description of the invention given above, and the detailed description of the embodiments given below, serve to explain the embodiments of the invention.

DETAILED DESCRIPTION

Before various exemplary embodiments of the invention are discussed in detail, it is to be understood that the invention is not limited in its application to the details of construction and arrangement of components set forth in the following description or illustrated in the following drawings. The invention is capable of other embodiments and can be adapted to suit many different types of gates, and can include components that can detect a fall-hazard in various ways. As used herein, a "gate" is intended to include various types of gates (such as a swing gate shown in FIGS. 1 and 2), a slide gate, a tilt gate, a scissor gate), doors, and other known moveable access devices.

Figure 1:
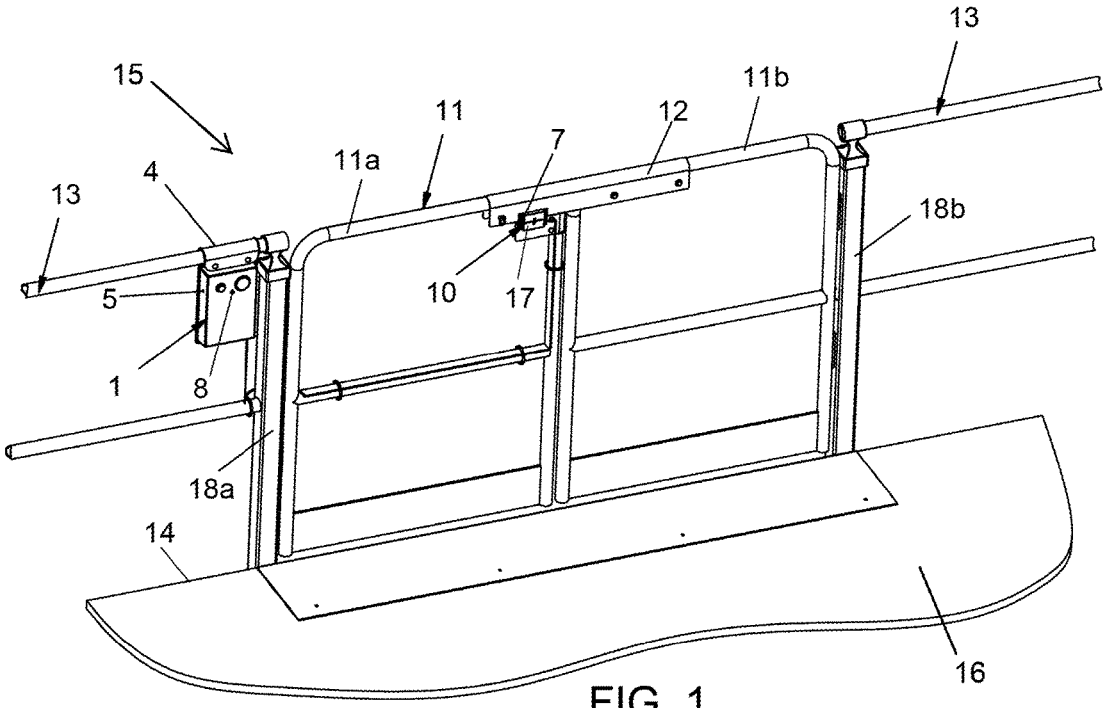
FIG. 1 is a perspective view of the hazard alert device for a swing gate, according to an exemplary embodiment of the invention.
Figure 2:
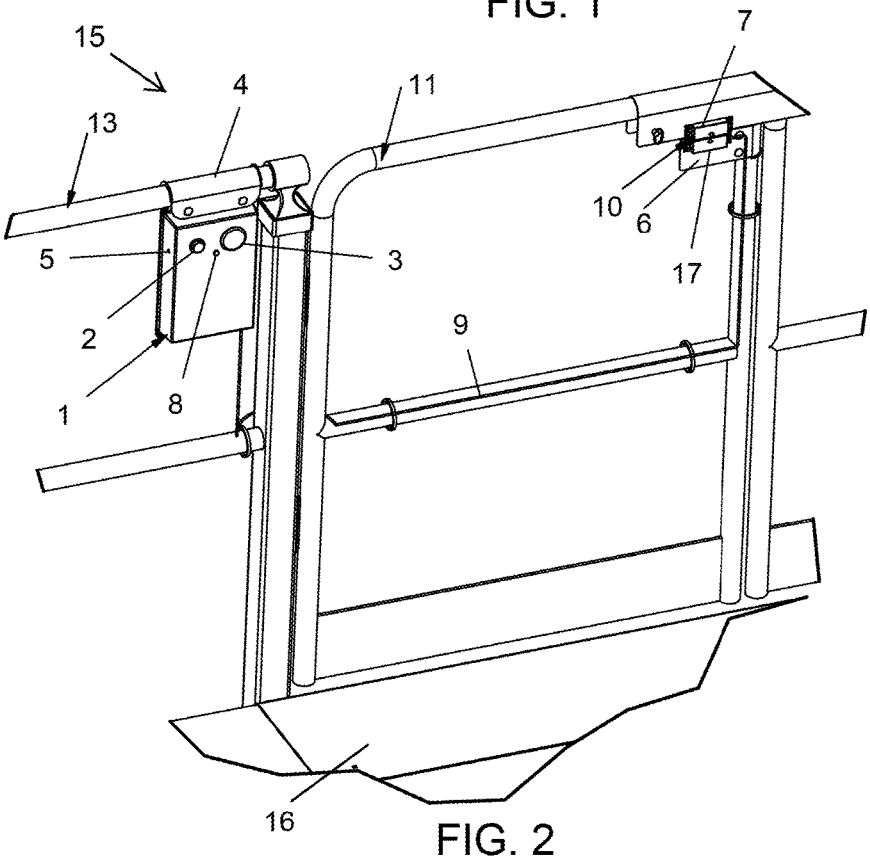
FIG. 2 is a detailed view of the hazard alert device of FIG. 1, more clearly showing the signaling device and the barrier sensor, according to an exemplary embodiment.
Figure 3:
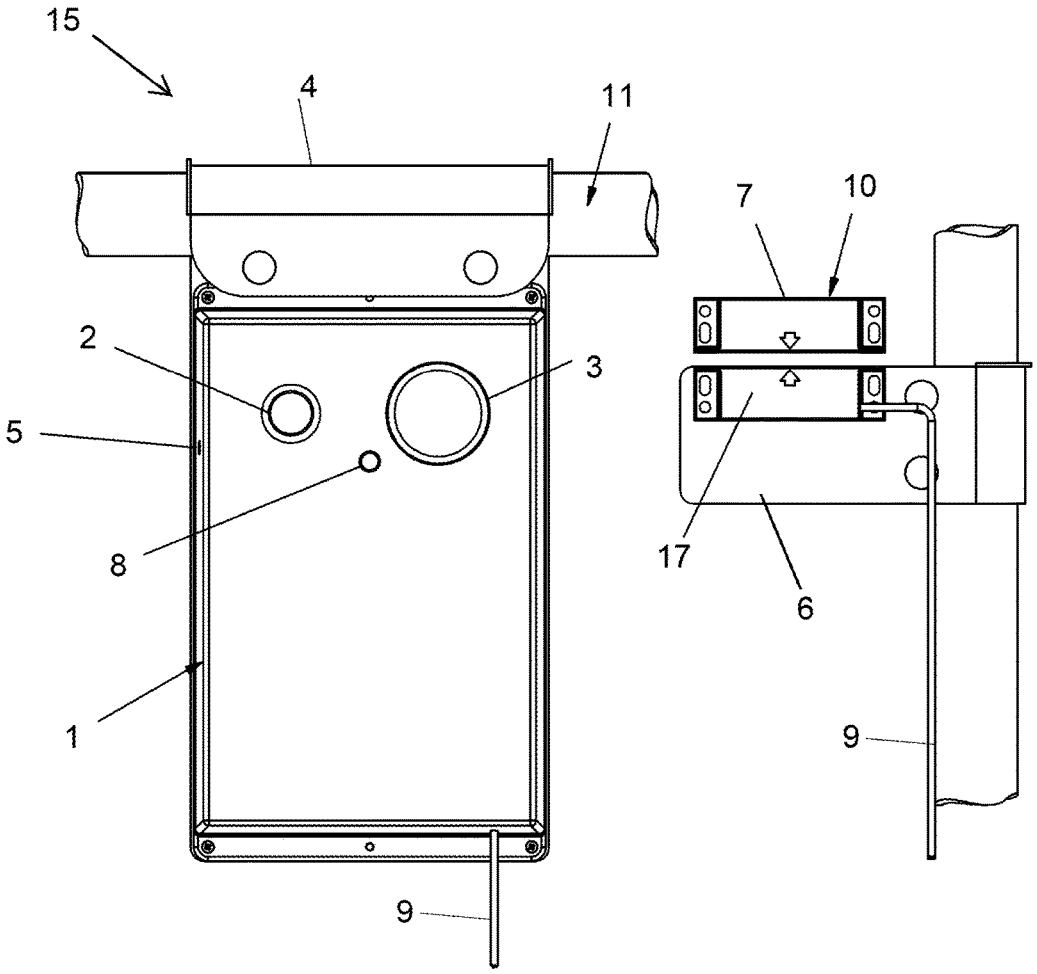
FIG. 3 is a front view of the hazard alert device, with the signaling device and barrier sensor being disconnected from the gate, according to an exemplary embodiment.

FIGS. 1 and 2 show an exemplary embodiment of the hazard alert device 15 including a barrier sensor 10, a signaling device 1, and a delay mechanism (such as snooze button 2) used to activate a "snooze" mode. Similarly, FIG. 3 shows the hazard alert device 15 disconnected from the elevated floor-edge gate 11. The hazard alert device 15 may be battery powered or connected to a power outlet. The hazard alert device 15 protects against the dangers associated with an elevated surface (such as platform 16) having a barrier 13 with an elevated floor-edge gate 11. Examples of such elevated surfaces include, but are not limited to: balconies, work platforms, storage mezzanines, loading docks, surfaces above pits, and catwalks.

FIGS. 1 and 2 show the barrier 13 as including an opening extending between first and second vertical posts 18*a*, 18*b* of the barrier 13. An elevated floor-edge gate 11, including first and second elevated floor-edge gates 11*a*, 11*b*, is provided within the opening along an edge 14 of the platform 16. The elevated floor-edge gate 11 is movable between a closed position (shown) and an open position (not shown). The closed position obstructs the edge 14 of the platform 16 and generally prevents the movement of people and/or material from passing through the opening, while the open position allows for people and/or material to freely pass through the opening.

A locking mechanism (e.g., slide-latch 12, discussed below) may be incorporated to couple the first and second elevated floor-edge gates, 11*a* and 11*b*, and to prevent the first and second elevated floor-edge gates, 11*a* and 11*b*, from unintentionally opening. Decoupling the locking mechanism causes the first and second elevated floor-edge gates, 11*a* and 11*b*, to move from a locked position to an unlocked position. FIG. 1 illustrates an example locking mechanism. In this example, the locking mechanism is a slide-latch 12 that moves laterally, in a direction generally parallel to the opening, to disconnect the first elevated floor-edge gate 11*a* from the second elevated floor-edge gate 11*b*. The first elevated floor-edge gate 11*a* is hingedly connected to the first vertical post 18*a* using a first hinge (not shown), while the first elevated floor-edge gate 11*b* is hingedly connected to the second vertical post 18*b* using a second hinge (not shown). After the slide-latch 12 is decoupled, at least one of the first elevated floor-edge gate 11*a*, or the second elevated floor-edge gate 11*b*, pivots from the closed position to the open position. Upon moving the slide-latch 12 from the locked to unlocked position, the first sensing element (shown as forming part of magnet 7) is no longer aligned with the second sensing element (shown as forming part of receiver 17).

Figure 4:
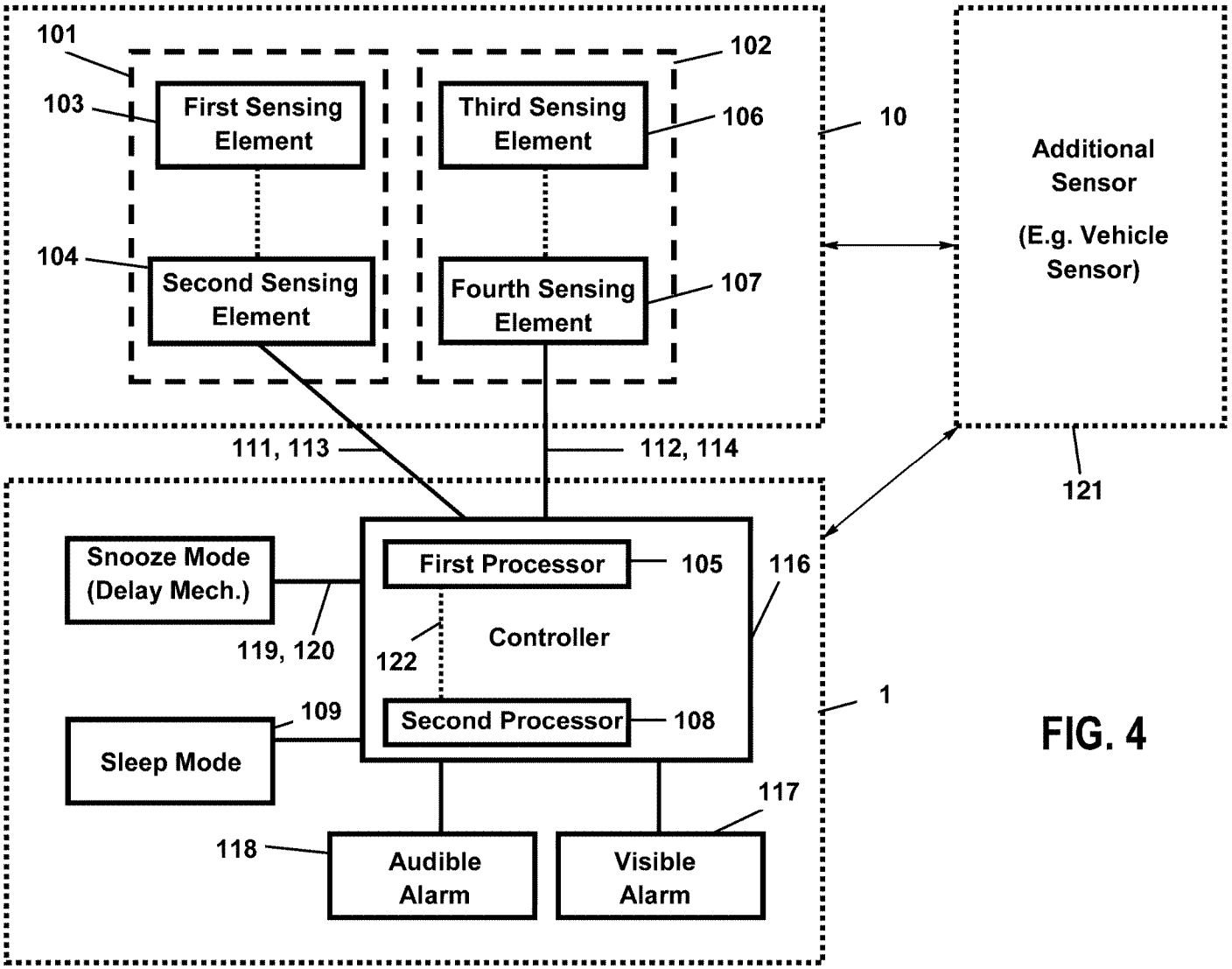
FIG. 4 is a block diagram of the hazard alert device, according to an exemplary embodiment.

The barrier sensor 10, mounted to the sensor bracket 6, includes the magnet 7, and the receiver 17. The barrier sensor 10 is configured to transmit a signal (may include first and second return signals 113, 114 as shown in FIG. 4) to determine whether the elevated floor-edge gate 11 is in the closed position. According to an embodiment, the barrier sensor 10, shown in FIGS. 1-3, may be a dual-channel magnetic sensor, for example, a SMS03 Series Rectangular Safety Magnetic Sensor, commercially available from Carlo Gavazzi of Buffalo Grove, Ill. However, persons of ordinary skill in the art would appreciate that in other embodiments the barrier sensor 10 may comprise other types of sensors including, but not limited to: a magnetic switch, a electromechanical switch, a electromagnetic sensor, an ultrasonic proximity sensor, a proximity switch, a photoelectric eye, and/or a Hall Effect sensor.

As discussed below in reference to block diagram of FIG. 4, in further embodiments, the barrier sensor 10 may have redundant (dual-channel) electrical contacts that may be in an open position when the receiver 17 is not within a predetermined distance from the magnet 7. When the electrical contacts are in an open position, the flow of electrical current through the first and second wires that are connected to the signaling device 1 is interrupted. As shown in FIGS. 1-3, according to an embodiment, the first and second wires may be housed in the same sensor wire casing 9. However, in further embodiments, the first and second wires may be housed in different wire casings 9 to generate further redundancy.

According to an embodiment, signaling device 1, mounted to module bracket 4, may be in operative communication with the barrier sensor 10, and may be configured to provide a visible alarm 117 (such a flashing light 3 shown in FIGS. 1-3) and/or an audible alarm (such as pulsing horn 5 shown in FIGS. 1-3) in response to the elevated floor-edge gate 11 not being in the closed position. According to an embodiment, the flashing light 3 and the pulsing horn 5 may be continuously active until the first and second elevated floor-edge gates, 11*a* and 11*b*, are brought into the closed position or until the snooze mode 119 is initiated, as discussed in greater detail below. According to an embodiment, the visible alarm may comprise one or more light emitting diodes ("LEDs") located on the front and back of the signaling device 1 that allow the visible alarm 117 to be seen at multiple angles (such as at elevated and ground levels).

The delay mechanism 120 (shown as snooze button 2 in FIGS. 2 and 3) is shown as being formed within the signaling device 1, however, this is not required. According to an embodiment, the delay mechanism 120 allows the pulsing horn 5 to be temporarily silenced by a user manually pressing a snooze button 2 when material handling personnel are actively moving material through the elevated floor-edge gate 11, (shown as elevated floor-edge gate 11). This allows a delay of a predetermined period of time. According to an embodiment, the predetermined time may be two minutes. In further embodiments, the predetermined time may be any desired time that may be chosen for convenience. Once the predetermined period of time has elapsed, additional delays (such as another two minutes) can be initiated by the user, for example, by the user again manually pressing the snooze button 2. The volume of the audible alarm 118 may be manually adjusted depending on the location of the hazard alert device 15 and the preference of the users. For example, the audible alarm may have three different loudness levels: low, medium, and high. According to an embodiment, the low, medium, and high loudness values may be chosen to be 75, 83, and 90 dB at a distance of 24 inches from the speaker. In further embodiments, any other loudness values may be chosen for convenience.

According to an embodiment, during the predetermined time in which the snooze mode is engaged, the flashing light 3 may continue to be illuminated to indicate that the open-gate hazard exists. According to an embodiment, when the elevated floor-edge gates, 11*a* and 11*b*, and slide-latch 12 are returned to the fully closed and locked position the electrical contacts of barrier sensor 10 return to a closed position. This shuts off the flashing light 3 and silences the pulsing horn 5, if it has not already been silenced by the snooze mode.

The block diagram of FIG. 4 illustrates an embodiment in which the hazard alert device 15 includes a barrier sensor 10 and a signaling device 1. In this embodiment, the barrier sensor 10 includes first and second sensors 101, 102. The first sensor 101 includes first and second sensing elements 103, 104. Each of the first and second sensors 101, 102 are coupled to the first processor 105 and the second processor 108. The first and second processors 105, 108 form part of the controller 116. The first sensing element 103 may be a first magnet 7, with the second sensing element 104 sensing when the first sensing element 103 is no longer positioned within a predetermined distance from the second sensing element 104. According to an embodiment, the predetermined distance may be ⅞ inches. In further embodiments, the predetermined distance may be any distance chosen for convenience. The first sensing element 103 may be positioned proximate (e.g., within ⅞ inches) the second sensing element 104 when the elevated floor-edge gate 11 is in the closed position.

According to an embodiment, for redundancy, the barrier sensor 10 may also include a second sensor 102, which includes third and fourth sensing elements 106, 107. Each of the first and second sensors 101, 102 are connected to the first processor 105 as well as the second processor 108. These first and second processors 105, 108 form part of the controller 116. The third sensing element 106 may be proximate the fourth sensing element 107 when the elevated floor-edge gate 11 is in the closed position and may be not proximate the fourth sensing element 107 when the elevated floor-edge gate 11 is in the open position. The first and third sensing elements 103, 106 may be incorporated to magnet 7 (as shown in FIGS. 1-3), or utilize different magnets. Additionally, the second and fourth sensing elements, 104 and 107, along with the first and second processors, 105 and 108, may be housed in the receiver 17 (as shown in FIGS. 1-3).

According to an embodiment, the first processor 105 may transmit a first signal 111 and a second signal 112 to the sensing elements and receives first and second return signals 113, 114 only when the first sensing element 103 is proximate the second sensing element 104 and third sensing element 106 is proximate the fourth sensing element 107. Specifically, dual electronic, first and second processors, 105 and 108, may interact with the barrier sensor 10 and continually compare the first and second return signals, 113 and 114, from the redundant (dual-channel) electrical contacts of barrier sensor 10. If there is a discrepancy between the first and second return signals, 113 and 114, then the fault-light 8 (shown in FIGS. 1-3) may illuminate to indicate a problem with at least one of the first and second sensors, 101 and 102, or the first and second wires. The first and second processors 105, 108 each monitor the first and second return signals 113, 114, and either the first processor 105 or the second processor 108 can place the device into a fault mode should the first and second return signals 113, 114 not agree with each other.

The signaling device 1 may then compare the first and second return signals, 113 and 114. The signaling device 1 may further active a visible alarm 117 and an audible alarm 118 when the first and second return signals, 113 and 114, are not both indicating the gate is in the closed position. When either or both, of the first and second sensing elements, 103 and 104, or the third and fourth sensing elements, 106 and 107, are separated by a greater distance than the predetermined distance (indicating the open position), the signaling device 1 may activate an alarm, for example, by illuminating a flashing light 3, sounding a pulsing horn 5, or both. Either the first processor 105 or the second processor 108 can activate an alarm.

According to an embodiment, once activated, the delay mechanism 120 is configured to silence the audible alarm 118 for a predetermined period of time, to maintain the visible alarm 117 throughout the predetermined period of time, to reinitiate the audible alarm 118 once the predetermined period of time has elapsed, or a combination thereof.

According to an embodiment, signaling device 1 may include a sleep mode 109 that conserves power and extends the life of the battery. For applications where the barrier sensor 10 is powered by batteries, the battery life can be extended by automatically placing the first and second processors, 105 and 108, in a sleep mode 109 when the barrier 13 is in the closed position. The first and second processors 105, 108 coordinate sleep modes by using a communication link 122. This sleep mode 109 may be interrupted momentarily at a predetermined interval. According to an embodiment, the predetermined interval may be one second (during which time a check for a closed signal from the barrier sensor 10 may be preformed). In further embodiments, the predetermined interval may be any interval chosen for convenience. The signaling device 1 may also include a low battery chirp alert to alert a user that the batteries need to be replaced.

In another exemplary embodiment, the elevated surface may be a loading dock. According to this embodiment, the hazard alert device 1 may include a vehicle sensor 121 communicating with the signaling device 1 such that a visible alarm 117 and/or audible alarm 118 may be provided in response to a concurrence of the gate not being in the closed position, and the vehicle not being present.

According to an embodiment, signaling device 1 may include a computing device such as a controller 116. The controller 116 may be used to control and/or monitor the barrier sensor 10. The controller 116 may comprise one or more processors and may be configured to receive software and/or firmware updates wirelessly through an associated wireless data transmitter and receiver or through a hardware connection. The controller 116 may be connected to any part of the hazard alert device 15 for central control, remote control, general monitoring, and/or data collection purposes. The wireless data transmitter and receiver may use Bluetooth, Wi-Fi, cellular, and/or any other acceptable radio frequency data transmissions and reception techniques that will be apparent to persons of ordinary skill in the relevant art(s) without departing from the spirit and scope of the disclosure.

Embodiments of the invention may be implemented in hardware, firmware, software, or any combination thereof. Embodiments of the invention may also be implemented as instructions supplied by a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical optical, acoustical or other forms of propagated signals (e.g., carrier waves, infrared signals, digital signals, etc.), and others. Further firmware, software routines, and instructions may be described herein as performing certain actions. However, it should be appreciated that such descriptions are merely for convenience and that such actions in fact result from computing devices, processors, controllers, or other devices executing the firmware, software, routines, instructions, etc.

For purposes of this discussion, each of the various components discussed may be considered a module, and the term "module" shall be understood to include at least one of software, firmware, and hardware (such as one or more circuit, microchip, or device, or any combination thereof), and any combination thereof. In addition, it will be understood that each module may include one, or more than one, component within an actual device, and each component that forms a part of the described module may function either cooperatively or independently of any other component forming a part of the module. Conversely, multiple modules described herein may represent a single component within an actual device. Further, components within a module may be in a single device or distributed among multiple devices in a wired or wireless manner.

The above Detailed Description of the exemplary embodiments fully reveal the general nature of the invention that others can, by applying knowledge of those skilled in the relevant art(s), readily modify and/or adapt for various applications such exemplary embodiments, without undue experimentation, without departing from the spirit and scope of the disclosure. Therefore, such adaptations and modifications are intended to be within the meaning and plurality of equivalents of the exemplary embodiments based upon the teaching and guidance presented herein. It is to be understood that the phraseology or terminology herein is for the purpose of description and not of limitation, such that the terminology or phraseology of the specification is to be interpreted by those skilled in relevant art(s) in light of the teachings herein.

What is claimed is:

1. A hazard alert device configured for an elevated surface having a barrier and a gate disposed along an edge of the elevated surface, the gate being switchable between a closed position that obstructs the edge of the elevated surface and prevents movement of at least one of people or material, and an open position that allows for the movement of at least one of people or material, the device comprising:

a barrier sensor configured to sense whether the gate is in the closed position and to generate a closed signal in response thereto; and a signaling device in operative communication with the barrier sensor, and configured to provide a visible alarm and an audible alarm when the barrier sensor has not generated the closed signal indicating the gate is in the open position, the signaling device further including a delay mechanism having a non-activated state and an activated state manually activated by a user, wherein in the activated state, the delay mechanism is configured to:

a) silence the audible alarm for a predetermined period of time, b) maintain the visible alarm throughout the predetermined period of time, and c) reinitiate the audible alarm once the predetermined period of time has elapsed wherein after the predetermined period of time has elapsed, the activated state of the delay mechanism is again manually activated by the user and is configured to:

a) silence the audible alarm for the predetermined period of time, b) maintain the visible alarm throughout the predetermined period of time, and c) reinitiate the audible alarm once the predetermined period of time has elapsed, wherein the barrier sensor further comprises:

a first sensor including first and second sensing elements and first and second processors operatively coupled to the first or second sensing elements, wherein the first sensing element is proximate the second sensing element when the gate is in the closed position and not proximate the second sensing element when the gate is in the open position; and a second sensor including third and fourth sensing elements and the first and second processors operatively coupled to the third or fourth sensing elements, wherein the third sensing element is proximate the fourth sensing element when the gate is in the closed position and not proximate the fourth sensing element when the gate is in the open position, wherein the signaling device is configured to:

a) receive first and second signals from the first and second processors, b) compare the first signal and the second signal, and c) then activate the visible alarm and the audible alarm if the first and second signals are not both indicating the gate is in the closed position, and wherein the gate includes first and second swing gates and a locking mechanism, the first swing gate being rotatably coupled to a first post of the barrier and the second swing gate being rotatably coupled to a second post of the barrier, the locking mechanism configured to prevent the first and second swing gates from unintentionally opening, thereby establishing a locked position of the locking mechanism, such that the visible alarm and the audible alarm activates if the first and second signals are not indicating the first and second swing gates are in the closed position.

2. The hazard alert device of claim 1, wherein the first and second processors communicate with each other to ensure that the first and second signals are both indicating the gate is in the closed position.

3. The hazard alert device of claim 1, wherein the elevated surface is a loading dock, and the hazard alert device further comprises:

a vehicle sensor communicating with the signaling device such that the visible alarm and the audible alarm activate in response to a concurrence of the gate not being in the closed position and a vehicle not being present.

4. The hazard alert device of claim 1, wherein the hazard alert device is battery powered and the signaling device comprises:

a sleep mode that conserves power and extends battery life; and a low battery audible alert.

5. The hazard alert device of claim 1, wherein the barrier sensor further comprises:

a first sensor including first and second sensing elements and first and second processors operatively coupled to the first or second sensing elements, wherein the first sensing element is proximate the second sensing element when the gate is in the closed position and not proximate the second sensing element when the gate is in the open position; and a second sensor including third and fourth sensing elements and the first and second processors operatively coupled to the third or fourth sensing elements, wherein the third sensing element is proximate the fourth sensing element when the gate is in the closed position and not proximate the fourth sensing element when the gate is in the open position, wherein the signaling device is configured to:

a) receive first and second signals from the first and second processors, b) compare the first signal to the second signal, and c) then illuminate a fault-light indicating a fault mode, distinct from the visible alarm, when the first and second signals do not agree with one another.

6. The hazard alert device of claim 1, wherein when the barrier is in the closed position, a sleep mode conserves power by automatically checking for the closed signal of the barrier sensor at a predetermined interval.

7. The hazard alert device of claim 1, wherein the locking mechanism is a slide-latch that moves laterally, in a direction generally parallel to the edge, to disconnect the first and second swing gates, and wherein when the slide-latch is moved from an locked position to an unlocked position, the first sensing element is no longer aligned with the second sensing element, both the visible alarm and the audible alarm activate.

8. A hazard alert system configured for an elevated surface, the system comprising:

a barrier including first and second swing gates pivotal about a pair of spaced vertical axes, the first and second swing gates being alignable along a plane;

a locking mechanism to lock the first and second swing gates in alignment along the plane such that the first and second swing gates are switchable between a locked position that locks the first and second swing gates together and prevents movement of at least one of people or material, and an unlocked position that allows for the movement of at least one of people or material;

a hazard alert device including:

a barrier sensor having a swing gate mounted portion and a locking mechanism mounted portion, the portions being in alignment when the first and second swing gates are aligned along the plane and when the locking mechanism is in the locked position;

a signaling device mounted to the barrier located adjacent with and in alignment with one of the first and second swing gates, the signaling device including a delay mechanism having a non-activated state and an activated state manually activated by a user; and a controller located internal to the signaling device and operatively connected to the swing gate mounted portion of the barrier sensor, and also operatively connected to an audible alarm and a visible alarm, wherein when the delay mechanism is in the activated state and the locking mechanism is in the unlocked position, the controller is configured to:

a) silence the audible alarm for a predetermined period of time, b) maintain the visible alarm throughout the predetermined period of time, and c) reinitiate the audible alarm once the predetermined period of time has elapsed, wherein when the delay mechanism is in the non-activated state and the locking mechanism is in the unlocked position, the swing gate mounted portion is no longer aligned with the locking mechanism mounted portion, whereby the controller is configured to activate both the visible alarm and the audible alarm.

9. The hazard alert system of claim 8, wherein the barrier sensor further comprises:

a first sensor including first and second sensing elements and first and second processors operatively coupled to the first or second sensing elements, wherein the first sensing element is proximate the second sensing element when the first and second swing gates are in the locked position and not proximate the second sensing element when the first and second swing gates are in the unlocked position; and a second sensor including third and fourth sensing elements and the first and second processors operatively coupled to the third or fourth sensing elements, wherein the third sensing element is proximate the fourth sensing element when the first and second swing gates are in the locked position and not proximate the fourth sensing element when the first and second swing gates are in the unlocked position, and wherein the signaling device is configured to:

a) receive first and second signals from the first and second processors, b) compare the first signal to the second signal, and c) then activate the visible alarm and the audible alarm if the first and second signals are not both indicating the first and second swing gates are in the locked position.

10. The hazard alert system of claim 8, wherein the controller and swing gate mounted portion are hard-wired together.

11. The hazard alert system of claim 8, wherein the signaling device includes a housing mounted near a top of the barrier and at a height which is accessible by a person who is standing.

12. The hazard alert device of claim 8, wherein after the predetermined period of time has elapsed, the activated state of the delay mechanism is again manually initiated by the user and the signaling device is configured to:

a) silence the audible alarm for the predetermined period of time, b) maintain the visible alarm throughout the predetermined period of time, and c) reinitiate the audible alarm once the predetermined period of time has elapsed.

13. The hazard alert device of claim 8, wherein the locking mechanism includes a slide-latch that moves laterally, in a direction generally parallel to the edge, to disconnect the first and second swing gates.

* * * * *